US009725959B2

(12) United States Patent
Gillis

(10) Patent No.: US 9,725,959 B2
(45) Date of Patent: Aug. 8, 2017

(54) CUTTER PROFILE FOR A FIXED CUTTER DRILL BIT

(71) Applicant: Drilformance Technologies, LLC, Conroe, TX (US)

(72) Inventor: Sean Gillis, Beaumont (CA)

(73) Assignee: DRILFORMANCE TECHNOLOGIES, LLC, Houston, TX (US)

( * ) Notice: Subject to any disclaimer, the term of this patent is extended or adjusted under 35 U.S.C. 154(b) by 321 days.

(21) Appl. No.: 14/314,820

(22) Filed: Jun. 25, 2014

(65) Prior Publication Data

US 2015/0075872 A1 Mar. 19, 2015

Related U.S. Application Data

(60) Provisional application No. 61/877,599, filed on Sep. 13, 2013.

(51) Int. Cl.
*E21B 10/16* (2006.01)
*E21B 10/43* (2006.01)

(52) U.S. Cl.
CPC ..... *E21B 10/43* (2013.01)

(58) Field of Classification Search
USPC ..... 175/336
See application file for complete search history.

(56) References Cited

U.S. PATENT DOCUMENTS

| | | | | |
|---|---|---|---|---|
| 8,386,181 | B2 | 2/2013 | Propes | |
| 8,689,908 | B2 | 4/2014 | Durairajan et al. | |
| 2010/0101870 | A1* | 4/2010 | Shamburger | E21B 10/04 175/431 |
| 2011/0127089 | A1 | 6/2011 | Beaton | |

* cited by examiner

*Primary Examiner* — Taras P Bemko
(74) *Attorney, Agent, or Firm* — Terrence N. Kuharchuk; Rodman & Rodman

(57) ABSTRACT

A cutter profile for a fixed cutter drill bit having a drill bit axis. The cutter profile includes a nose portion radially offset from the drill bit axis and surrounding the drill bit axis, a first cone-shaped depression centered on the drill bit axis and extending radially to the nose portion, and a second cone-shaped depression centered on the drill bit axis and extending radially toward the nose portion. A second depression diameter is smaller than a first depression diameter. A second depression maximum depth is greater than a first depression maximum depth. A second depression included angle is smaller than a first depression included angle.

12 Claims, 3 Drawing Sheets

CUTTER PROFILE FOR A FIXED CUTTER DRILL BIT

TECHNICAL FIELD

A cutter profile for a fixed cutter drill bit for use in drilling underground formations.

BACKGROUND OF THE INVENTION

Drill bits containing fixed cutters (such as PDC cutting elements) are generally designed by distributing the fixed cutters along a cutter profile (viewed from the side of the drill bit) that extends radially from the axis of the drill bit to the gauge (outer diameter) of the drill bit. The fixed cutters may be placed at varying positions along the cutter profile.

In the prior art, the shape of the cutter profile is typically some combination of a depression at the drill bit axis transitioning from a straight line into an arc, parabola or series of arcs that extend radially to the gauge of the drill bit. The depression is typically referred to as the cone portion of the drill bit and the arcs are usually referred to as the nose portion and shoulder portion of the drill bit. An example of this type of cutter profile can be seen in U.S. Patent Application Publication No. US 2011/0127089 (Beaton).

It is generally believed that the stability of a drill bit is enhanced by the cone portion of the drill bit. One theory is that during drilling, a conical region of rock is left by the cone portion of the drill hit which tends to reduce lateral movement of the drill bit, maintain concentric rotation of the drill bit, and mitigate damaging vibrations. It is also generally believed that the deeper the cone portion (and the steeper the cone portion), the more stability that is generated.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a cutter profile for a fixed cutter drill hit.

The cutter profile is comprised of a nose portion, a first cone-shaped depression defined by the drill bit, and a second cone-shaped depression defined by the drill bit. In some embodiments, the cutter profile may be further comprised of a shoulder portion.

The drill bit has a drill bit axis and a drill bit diameter (i.e., a gauge diameter).

The nose portion of the cutter profile is radially offset from the drill bit axis and surrounds the drill bit axis.

The first cone-shaped depression of the cutter profile is centered on the drill bit axis and extends radially from the drill bit axis. In some embodiments, the first cone-shaped depression may be a "right" or "perpendicular" cone shape so that a first depression axis is substantially parallel with the drill bit axis. In some embodiments, the sides of the first cone-shaped depression may be straight. In some embodiments, the sides of the first cone-shaped depression may be curved.

The second cone-shaped depression of the cutter profile is centered on the drill bit axis and extends radially from the drill bit axis. In some embodiments, the second cone-shaped depression may be a "right" or "perpendicular" cone shape so that a second depression axis is substantially parallel with the drill bit axis. In some embodiments, the sides of the second cone-shaped depression may be straight. In some embodiments, the sides of the second cone-shaped depression may be curved.

The first cone-shaped depression has a first depression diameter. The second cone-shaped depression has a second depression diameter. The first cone-shaped depression extends radially from the drill bit axis to the nose portion, so that the first cone-shaped depression meets the nose portion. The second cone-shaped depression extends radially from the drill bit axis a portion of the distance to the nose portion. As a result, the second depression diameter is smaller than the first depression diameter.

The first cone-shaped depression has a first maximum depression depth. The second cone-shaped depression has a second maximum depression depth. The second depression maximum depth is greater than the first depression maximum depth.

The first cone-shaped depression has a first depression included angle. The second cone-shaped depression has a second depression included angle. The first depression included angle is larger than the second depression included angle.

In one aspect, the invention is a cutter profile for a fixed cutter drill bit, wherein the drill bit has a drill bit axis, the cutter profile comprising:

(a) a nose portion radially offset from the drill bit axis and surrounding the drill bit axis;

(b) a first cone-shaped depression defined by the drill bit and centered on the drill bit axis, wherein the first cone-shaped depression extends radially from the drill bit axis to the nose portion, wherein the first cone-shaped depression has a first depression diameter, wherein the first cone-shaped depression has a first depression maximum depth, and wherein the first cone-shaped depression has a first depression included angle; and (c) a second cone-shaped depression defined by the drill bit and centered on the drill bit axis, wherein the second cone-shaped depression extends radially from the drill bit axis toward the nose portion, wherein the second cone-shaped depression has a second depression diameter, wherein the second cone-shaped depression has a second depression maximum depth, wherein the second cone-shaped depression has a second depression included angle, wherein the second depression diameter is smaller than the first depression diameter, wherein the second depression maximum depth is greater than the first depression maximum depth, and wherein the first depression included angle is larger than the second depression included angle.

The first depression diameter and the second depression diameter may each be any suitable diameter. In some embodiments, the first depression diameter may be between about 30 percent and about 75 percent of the drill bit diameter. In some embodiments, the second depression diameter may be between about 5 percent and about 25 percent of the drill bit diameter.

The first maximum depression depth and the second maximum depression depth may each be any suitable depth. In some embodiments, the ratio of the second depression maximum depth to the first depression maximum depth may be between about 2:1 and about 4:1.

The first depression included angle and the second depression included angle may be any suitable angle. In some embodiments, the first depression included angle may be between about 150 degrees and slightly less than about 180 degrees (i.e., about 179 degrees). In some embodiments, the second depression included angle may be between about 70 degrees and about 150 degrees.

In embodiments in which the cutter profile is comprised of a shoulder portion, the shoulder portion is radially offset from the drill bit axis and surrounds the drill bit axis. In some such embodiments, the nose portion of the cutter profile may extend radially from the first cone-shaped depression to the shoulder portion.

Any number of fixed cutters may be distributed along the cutter profile.

The fixed cutters may have any suitable shape. As non-limiting examples, the cutting faces of the fixed cutters may be circular, oval, or polygonal. The cutter profile may also include fixed cutters having different shapes. As a non-limiting example, the cutter profile may include polygonal shaped cutting faces in the inner cone and circular cutting faces in the outer cone and/or the nose portion and/or the shoulder portion of the cutter profile.

The fixed cutters may be distributed and configured along the cutter profile in any suitable manner.

As a first non-limiting example, the fixed cutters may each have a fixed cutter axis, and the fixed cutters may in some embodiments be configured so that the fixed cutter axes are coincident with the cutter profile.

As a second non-limiting example, the fixed cutters may each have a fixed cutter leading edge, and the fixed cutters may in some embodiments be configured so that the fixed cutter leading edges are coincident with the cutter profile.

BRIEF DESCRIPTION OF DRAWINGS

Embodiments of the invention will now be described with reference to the accompanying drawings, in which.

DETAILED DESCRIPTION

A fixed cutter drill bit may typically be comprised of a plurality of cutter blades which may extend radially from the drill bit axis or from a point adjacent to the drill bit axis in a straight line or an arc. The cutter profile of a fixed cutter drill bit may be defined at least in part by the cutter blades. In order to depict the cutter profiles clearly, FIGS. 1-4 do not depict cutter blades.

Figure 1:
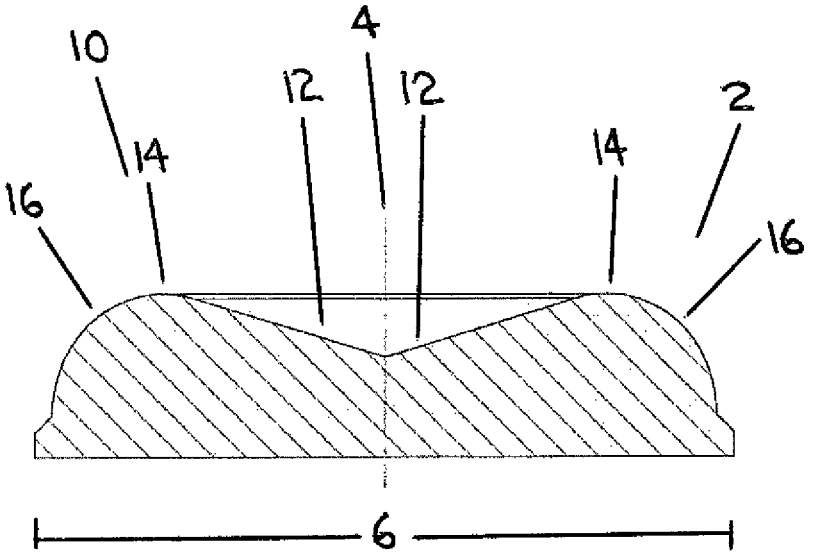
FIG. 1 (PRIOR ART)
FIG. 1 is a schematic side view drawing of a prior art cutter profile.
Figure 2:
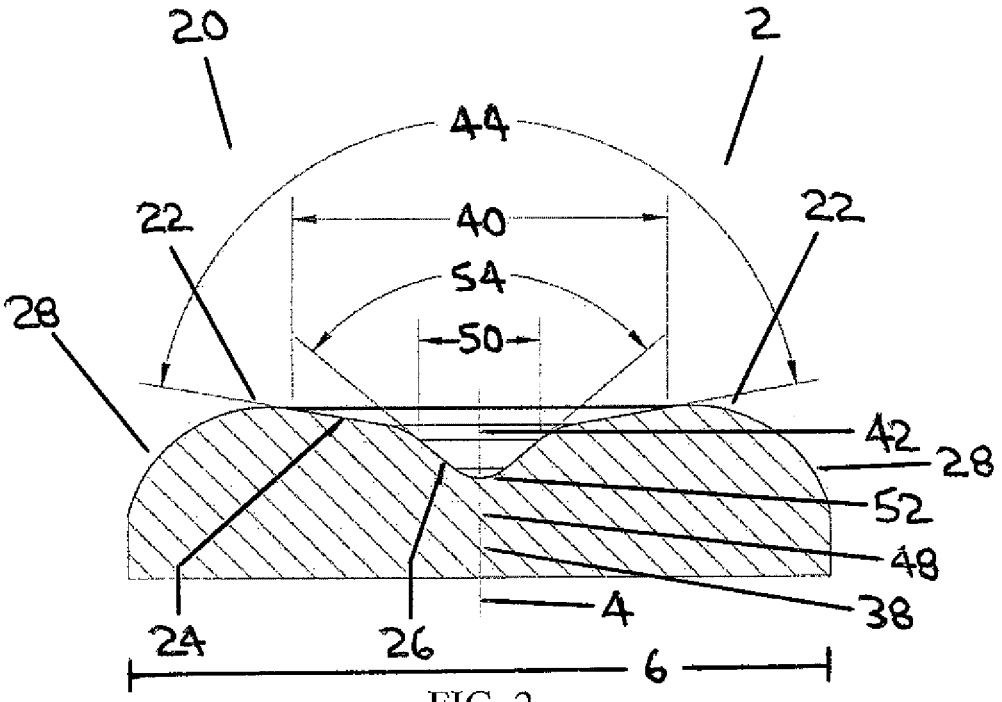
FIG. 2 is a schematic side view drawing depicting an exemplary embodiment of a cutter profile according to the present invention.

A comparison is provided in FIGS. 1-2 of a prior art cutter profile in FIG. 1 with an exemplary cutter profile according to the invention in FIG. 2. In order to depict the cutter profiles clearly, FIG. 1 and FIG. 2 do not include fixed cutters distributed along the cutter profiles.

The cutter profiles in FIGS. 1-2 are located at the distal end of a drill bit (2). The drill bit has a drill bit axis (4) and a drill bit diameter (6). The drill bit diameter (6) may be referred to as the "gauge diameter" of the drill bit (2).

Referring to FIG. 1, the prior art cutter profile (10) is comprised of a cone portion (12), a nose portion (14), and a shoulder portion (16).

Referring to FIG. 2, the exemplary cutter profile (20) is comprised of a nose portion (22), a first cone-shaped depression (24), a second cone-shaped depression (26) and a shoulder portion (28).

The nose portion (22) of the exemplary cutter profile (20) is radially offset from the drill bit axis (4) and surrounds the drill bit axis (4).

The first cone-shaped depression (24) of the exemplary cutter profile (20) is defined by the drill bit (2). In the exemplary embodiment, the first cone-shaped depression (24) is a "right" or "perpendicular" cone shape, so that a first depression axis (38) is substantially parallel with the drill bit axis (4).

The first cone-shaped depression (24) is centered on the drill bit axis (4) and extends radially from the drill bit axis (4) to the nose portion (22) so that the first cone-shaped depression (24) meets the nose portion (22). The first cone-shaped depression (24) has a first depression diameter (40), a first depression maximum depth (42), and a first depression included angle (44), in the exemplary embodiment, the sides of the first cone-shaped depression (24) are substantially straight.

The second cone-shaped depression (26) of the exemplary cutter profile (20) is defined by the drill bit (2). In the exemplary embodiment, the second cone-shaped depression (26) is a "right" or "perpendicular" cone shape, so that a second depression axis (48) is substantially parallel with the drill bit axis (4).

The second cone-shaped depression (26) is centered on the drill bit axis (4) and extends radially from the drill bit axis (4) toward the nose portion (22), but does not extend to the nose portion (22). The second cone-shaped depression (26) has a second depression diameter (50), a second depression maximum depth (52), and a second depression included angle (54). In the exemplary embodiment, the sides of the second cone-shaped depression (26) are substantially straight.

The shoulder portion (28) of the exemplary cutter profile (20) is radially offset from the drill bit axis (4) and surrounds the drill bit axis (4). In the exemplary embodiment, the nose portion (22) of the exemplary cutter profile (20) is interposed between the first cone-shaped depression (24) and the shoulder portion (28) and extends radially from the first cone-shaped depression (24) to the shoulder portion (28).

The second depression diameter (50) is smaller than the first depression diameter (40). The second depression maximum depth (52) is greater than the first depression maximum depth (42). The second depression included angle (54) is smaller than the first depression included angle (44).

In the exemplary cutter profile (20), the first depression diameter (40) is preferably between about 30% and about 75% of the drill bit diameter (6), and the second depression diameter (50) is preferably between about 5% and about 25% of the drill bit diameter (6).

In the exemplary cutter profile (20), the ratio of the second depression maximum depth to the first depression maximum depth is preferably between about 2:1 and about 4:1.

In the exemplary cutter profile (20), the first depression included angle (44) is preferably between about 150 degrees and about 179 degrees, and the second depression included angle (54) is preferably between about 70 degrees and about 150 degrees.

A plurality of fixed cutters (60) is distributed along the exemplary cutter profile (20). Each of the fixed cutters (60) has a fixed cutter face (62), a fixed cutter axis (64) and a fixed cutter leading edge (66).

The fixed cutter axis (64) is substantially perpendicular to the fixed cutter face (62). The fixed cutter leading edge (66) is the edge of the fixed cutter face (62) which projects furthest from the drill bit (2) and which therefore engages the formation during drilling.

Figure 3:
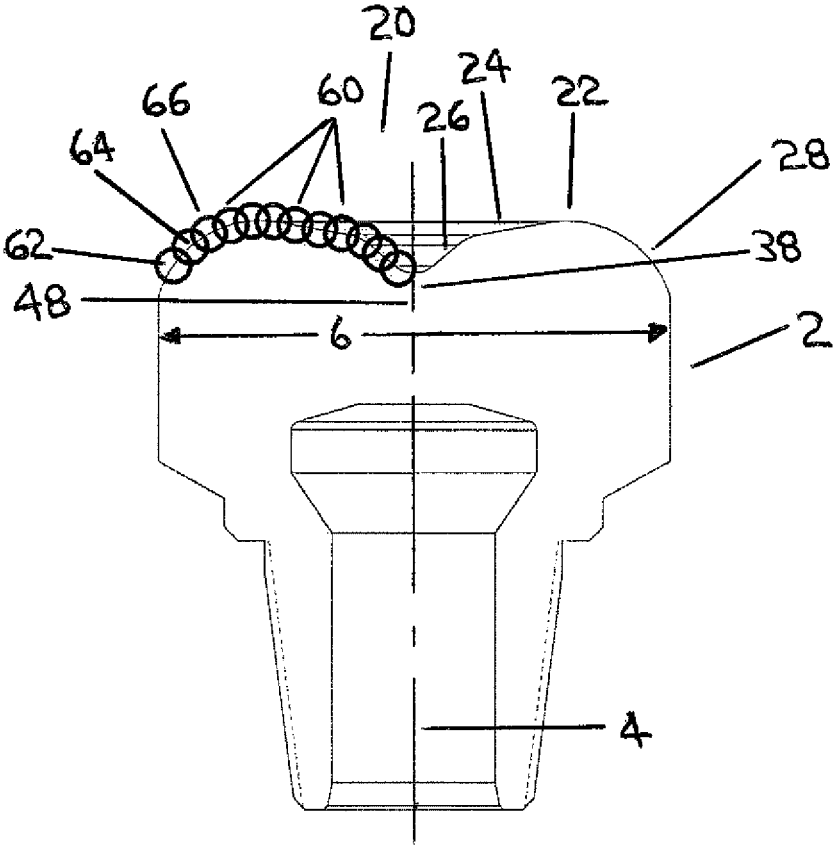
FIG. 3 is a schematic side view drawing of a fixed cutter drill bit, depicting an exemplary fixed cutter configuration along a cutter profile.
Figure 4:
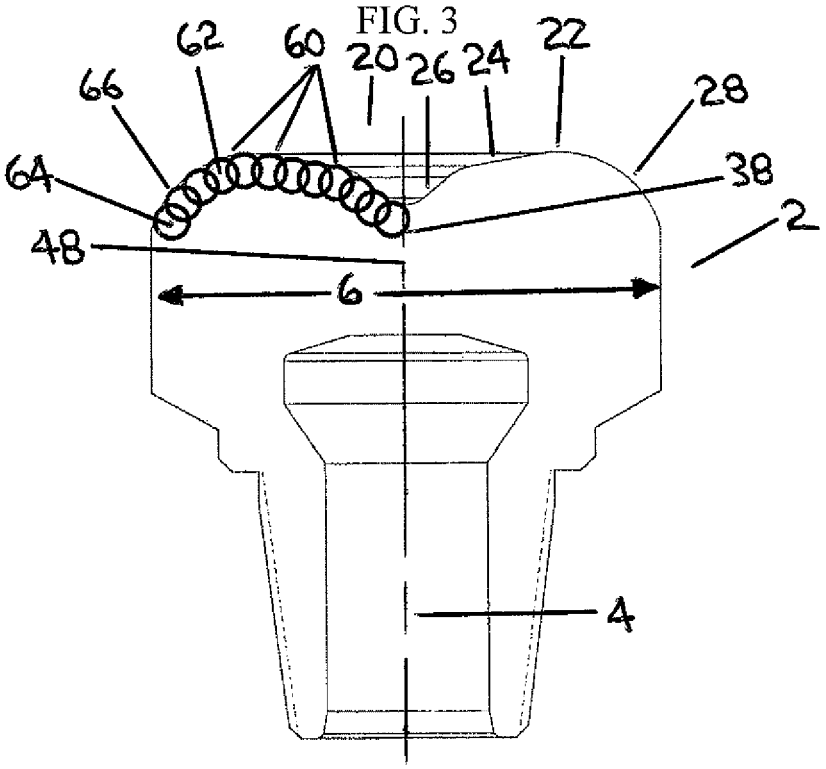
FIG. 4 is a schematic side view drawing of a fixed cutter drill bit, depicting an alternate exemplary fixed cutter configuration along a cutter profile.

Referring to FIGS. 3-4, two alternate configurations for the fixed cutters (60) along the exemplary cutter profile (20) are depicted. FIG. 3 depicts a configuration in which the fixed cutter axes (64) of the fixed cutters (60) are coincident with the exemplary cutter profile (20). FIG. 4 depicts a configuration in which the fixed cutter leading edges (66) of the fixed cutters (60) are coincident with the exemplary cutter profile (20).

Figure 5:
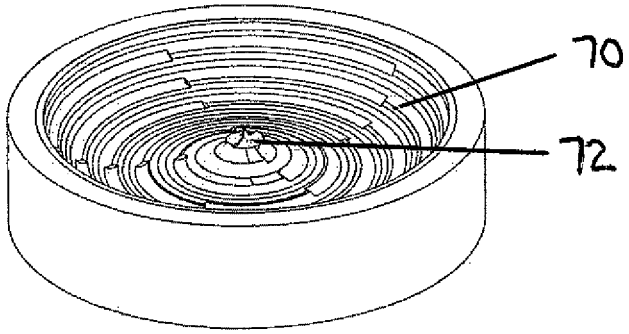
FIG. 5 is a schematic pictorial view depicting a possible shape of an end of a borehole drilled using a fixed cutter drill bit having a cutter profile according to the present invention.
Figure 6:
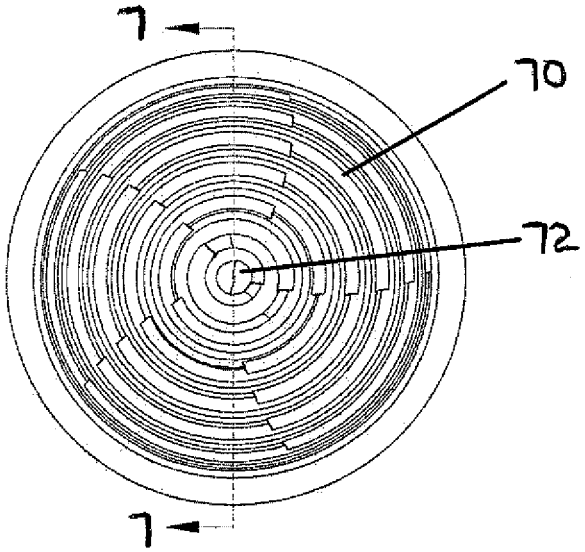
FIG. 6 is a schematic plan view of the end of the borehole depicted in FIG. 5.
Figure 7:
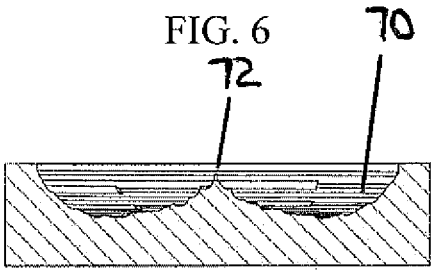
FIG. 7 is a schematic side section view of the end of the borehole depicted in FIG. 5, taken along section line 7-7 in FIG. 6.

Referring to FIGS. 5-7, it is believed that a drill bit (2) provided with a cutting profile according to the invention may during drilling of a borehole (70) generate a pattern at the end of the borehole (70) which is similar to the pattern depicted in FIGS. 5-7. The pattern includes a central raised region (72) defined and formed by the second cone-shaped depression (26). It is believed that this central raised region (72) may provide superior stability and other benefits not provided by prior art cutter profiles.

More particularly, it is believed that stability in a drill bit (2) is generally generated in relative close proximity to the drill bit axis (4) and that attempting to generate stability with a single cone portion (12) as in a prior art cutter profile (10) and/or with fixed cutters (60) removed a relatively large distance from the drill bit axis (4) may yield negative returns. This belief is based upon the fact that fixed cutters (60) relatively far removed from the drill bit axis (4) have a higher rotational velocity during rotation of the drill bit (2) than those fixed cutters (60) which are in relative close proximity to the drill bit axis (4).

It is theorized (without intending to be bound or constrained thereby) that fixed cutters (60) moving at relatively high rotational velocity may exhibit a greater tendency to break the material at the end of the borehole (70) that is believed to provide the stability. It is further theorized (without intending to be bound or constrained thereby) that fixed cutters (60) located near the drill bit axis (4) may destroy the material at the end of the borehole (70) in a much more controlled manner due to their relatively lower rotational velocity, which potentially allows the central raised region (72) at the end of the borehole (70) to remain intact.

Furthermore, a prior art cutter profile (10) which has a single relatively steep cone portion (12) provides a sharp transition between the cone portion (12) and the nose portion (14). It is believed that sharp transitions of this type may lead to premature breakdown of the fixed cutters (60) located in these regions (particularly if the drill bit (2) is transitioning from softer to harder material at the end of the borehole (70)). This effect may potentially be reduced in the fixed cutter profile of the invention, which includes the first cone-shaped depression (24) and the second cone-shaped depression (26), wherein the first cone-shaped depression (24) provides a relatively gentle transition between the second cone-shaped depression (26) and the nose portion (22).

An additional potential benefit of the fixed cutter profile of the invention may potentially result from the manner in which a drill bit (2) is intended to perform in a directional drilling operation with a bent sub motor.

A directional drilling operation may include two distinct phases of drilling: a sliding phase and a rotating phase. While in the rotating phase (drilling straight) with a bent sub motor it has been theorized that the center of rotation of the drill bit (2) can continually change due to a persistent side force applied to the drill bit (2). It has also been theorized that the oscillating (trochoidal) motion of the drill bit axis (4) which may be encountered during the rotating phase may lead to more efficient destruction of material adjacent to the drill bit axis (4), due to the rotating side force that may tend to shear the material.

As a result, when a drill bit (2) with a cutter profile according to the invention is operating during the rotating phase of directional drilling, a relatively effective breakdown of material adjacent to the second cone-shaped depression (26) may potentially occur. When, however, the drill bit (2) is operating during the sliding phase of directional drilling, the material adjacent to the second cone-shaped depression (26) is not subjected to the rotating side force and may therefore potentially remain intact, thereby potentially providing stability during the sliding phase.

As a result, it is believed that the cutter profile of the invention may potentially provide a simple means of providing a fixed cutter drill bit which has 2 distinct operating characteristics depending on the phase of a directional drilling operation which is being performed.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A cutter profile for a fixed cutter drill bit, wherein the drill bit has a drill bit axis, the cutter profile comprising:

(a) a nose portion radially offset from the drill bit axis and surrounding the drill bit axis;

(b) a first cone-shaped depression defined by the drill bit and centered on the drill bit axis, wherein the first cone-shaped depression extends radially from the drill bit axis to the nose portion, wherein the first cone-shaped depression has sides, wherein the first cone-shaped depression has a first depression diameter, wherein the first cone-shaped depression has a first depression maximum depth, and wherein the first cone-shaped depression has a first depression included angle; and (c) a second cone-shaped depression defined by the drill bit and centered on the drill bit axis, wherein the second cone-shaped depression extends radially from the drill bit axis toward the nose portion, wherein the second cone-shaped depression has sides, wherein the second cone-shaped depression has a second depression diameter, wherein the second cone-shaped depression has a second depression maximum depth, wherein the second cone-shaped depression has a second depression included angle, wherein the second depression diameter is smaller than the first depression diameter, wherein the second depression maximum depth is greater than the first depression maximum depth, and wherein the second depression included angle is smaller than the first depression included angle, so that the sides of the first cone-shaped depression extend from the nose portion to the second depression diameter, so that the sides of the second cone-shaped depression extend from the bit axis to the second depression diameter, and so that the sides of the first cone-shaped depression and the sides of the second cone-shaped depression meet at the second depression diameter.

2. The cutter profile as claimed in claim 1 wherein the drill bit has a drill bit diameter and wherein the first depression diameter is between 30% and 75% of the drill bit diameter.

3. The cutter profile as claimed in claim 2 wherein the second depression diameter is between 5% and 25% of the drill bit diameter.

4. The cutter profile as claimed in claim 1 wherein a ratio between the second depression maximum depth and the first depression maximum depth is between 2:1 and 4:1.

5. The cutter profile as claimed in claim 1 wherein the first depression included angle is between 150 degrees and 179 degrees.

6. The cutter profile as claimed in claim 5 wherein the second depression included angle is between 70 degrees and 150 degrees.

7. The cutter profile as claimed in claim 1, further comprising a shoulder portion radially offset from the drill bit axis and surrounding the drill bit axis.

8. The cutter profile as claimed in claim 7 wherein the nose portion extends radially from the first cone-shaped depression to the shoulder portion.

9. The cutter profile as claimed in claim 1, further comprising a plurality of fixed cutters each having a fixed cutter axis, wherein the fixed cutters are arranged along the cutter profile so that the fixed cutter axes are coincident with the cutter profile.

10. The cutter profile as claimed in claim 1, further comprising a plurality of fixed cutters each having a fixed cutter leading edge, wherein the fixed cutters are arranged along the cutter profile so that the fixed cutter leading edges are coincident with the cutter profile.

11. The cutter profile as claimed in claim 1 wherein the sides of the first cone-shaped depression are substantially straight sides.

12. The cutter profile as claimed in claim 11 wherein the sides of the second cone-shaped depression are substantially straight sides.

* * * * *